US006273079B1

(12) United States Patent
Jzn

(10) Patent No.: US 6,273,079 B1
(45) Date of Patent: Aug. 14, 2001

(54) RAPID DETACHABLE STRUCTURE FOR COLOR BALL TOY GUN

(76) Inventor: Amy Jzn, 5F, No. 11, Lane 337, Yung-Ho Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/669,591

(22) Filed: Sep. 26, 2000

(51) Int. Cl.[7] ..... F41B 11/02
(52) U.S. Cl. ..... 124/49; 124/45
(58) Field of Search ..... 124/56, 45, 49, 124/73, 74

(56) References Cited

U.S. PATENT DOCUMENTS 1,205,166 * 11/1916 Dettra ..... 124/49 X
2,456,159 * 12/1948 Tratsch ..... 124/45
2,573,884 * 11/1951 Wells ..... 124/45
5,257,615 * 11/1993 Jones ..... 124/49 X
5,361,746 * 11/1994 Szente ..... 124/49 X
5,673,679 * 10/1997 Walters ..... 124/49 X
5,832,911 * 11/1998 Mayville et al. ..... 124/73

* cited by examiner

*Primary Examiner*—John A. Ricci
(74) *Attorney, Agent, or Firm*—Rosenberg, Klein & Lee

(57) ABSTRACT

A rapid detachable structure for color ball toy gun includes anchor seats located on a barrel and a rapid detaching device located on a magazine. The rapid detaching device may be engaged or disengaged with the anchor seats quickly for users to replace a depleted magazine with a filled magazine rapidly. Users thus may play games smoothly without the interruption of removing and refilling the depleted magazines.

19 Claims, 6 Drawing Sheets

RAPID DETACHABLE STRUCTURE FOR COLOR BALL TOY GUN

FIELD OF THE INVENTION

The present invention relates to a rapid detachable structure for color ball toy gun and particularly a rapid detachable structure for rapidly removing and replacing magazines on a color ball toy gun.

BACKGROUND OF THE INVENTION

"Survival Game" is a popular leisure time sport activity nowadays. Players need swift response and extraordinary intelligence to beat adversaries to win the game. In the game, a pneumatic toy gun powered by high air pressure will be used to eject colorful cartridges. The cartridges are generally made of soft materials and shaped like balls to minimize risk and possible injury to the players.

The toy gun mainly includes a stock, a barrel, a cartridge firing means and a pneumatic control means. The barrel generally has a magazine mounted thereon for storing the cartridges. Because of size constraints in the magazine and cartridge, cartridge capacity of the magazine is usually limited. When the magazine is depleted of cartridges, it should be refilled with cartridges to continue the game. The magazine shall be detached and removed from the barrel for the refilling job. It takes times and becomes an annoying interruption that may spoil the game.

In the game, time is critical for making quick response to any situation that might happen. The delay and interruption of refilling cartridges in the magazine could put the players in a great disadvantage or even risky situation. On the other hand, the players may gain greater advantage for wining the game if refilling time of the magazine could be effectively reduced.

SUMMARY OF THE INVENTION

It is an object of the present invention to resolve aforesaid shortcomings by providing a rapid detachable structure that may be deployed on the magazine and the barrel so that players may rapidly detach a depleted magazine and replace a filled magazine to enable the game play proceeding more smoothly.

BRIEF DESCRIPTION OF THE DRAWINGS

The invention, as well as its many advantages. may be further understood by the following detailed description and drawings, in which:

FIG. 3-1 is a side view of the present invention, at an assembled state.

FIG. 3-2 is a front view of the present invention, according to FIG. 3-1.

FIG. 4-1 is a fragmentary side view of the present invention, at an engaging state.

FIG. 4-2 is a fragmentary side view of the present invention, at a detaching state.

FIG. 4-2 is a fragmentary side view of the present invention, at a removed state.

FIG. 4-4 is a fragmentary side view of the present invention, at a mounting state.

DETAILED DESCRIPTION OF THE PREFERRED EMBODIMENTS

Figure 1:
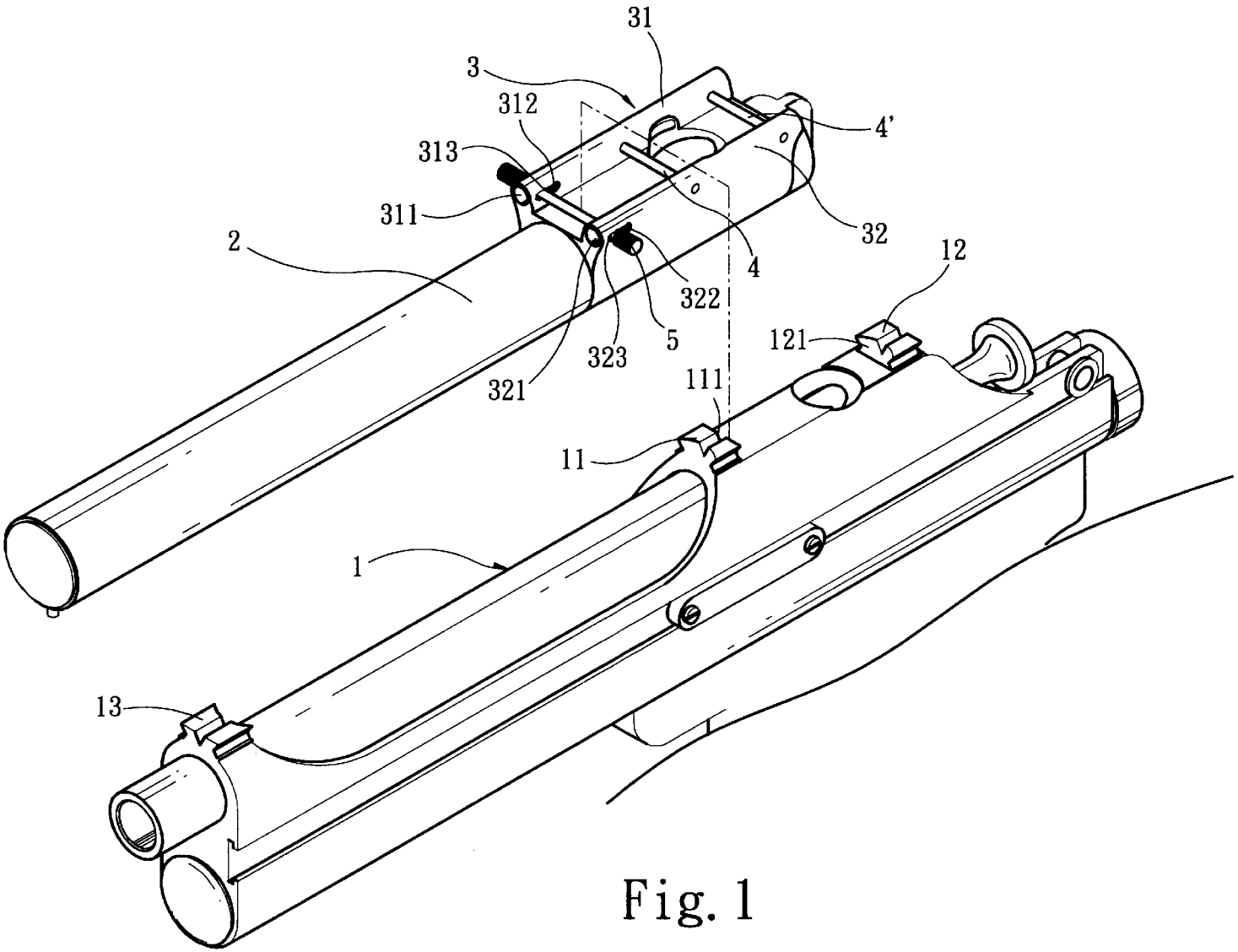
FIG. 1 is a perspective view of the present invention, at a detached state.
Figure 2:
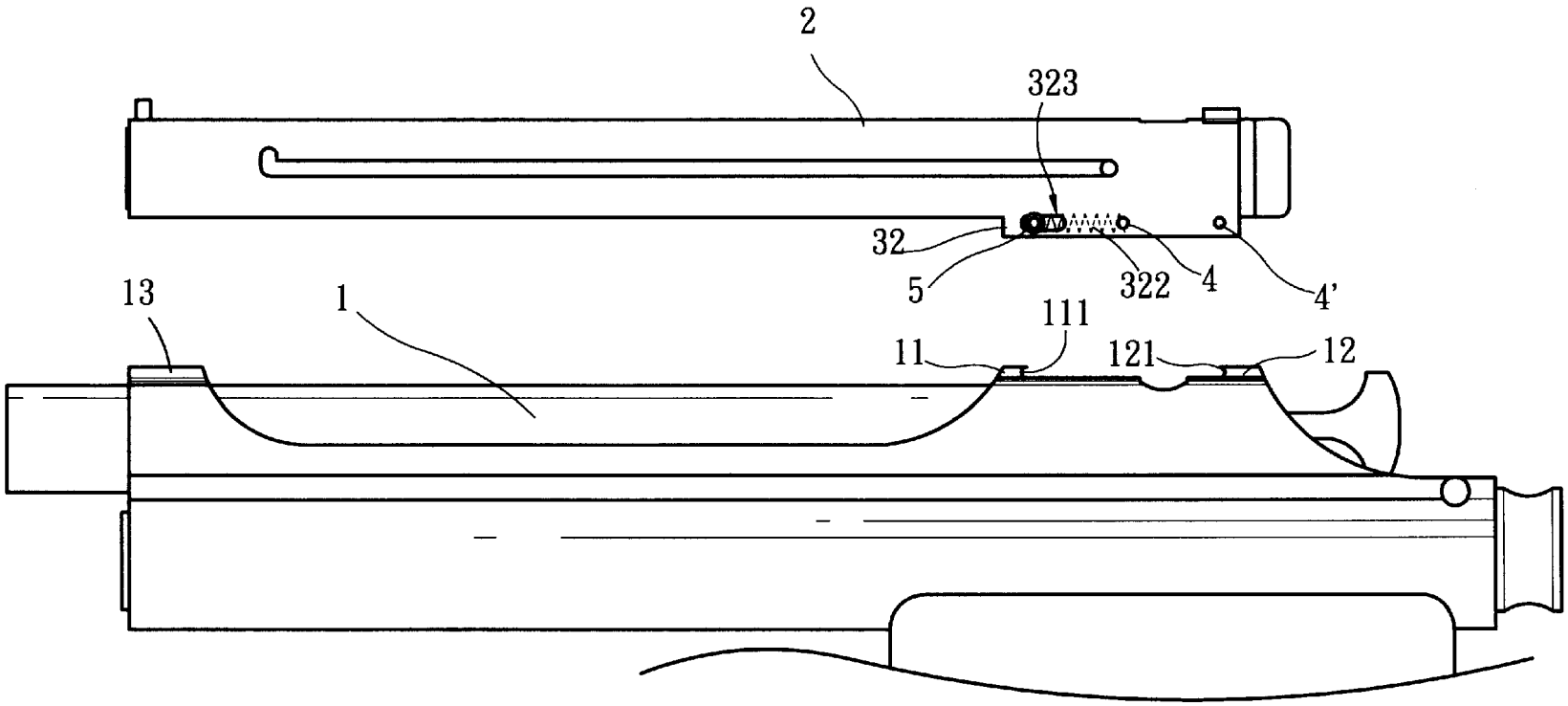
FIG. 2 is a side view of the present invention, according to FIG. 1.
Figures 1, 3:
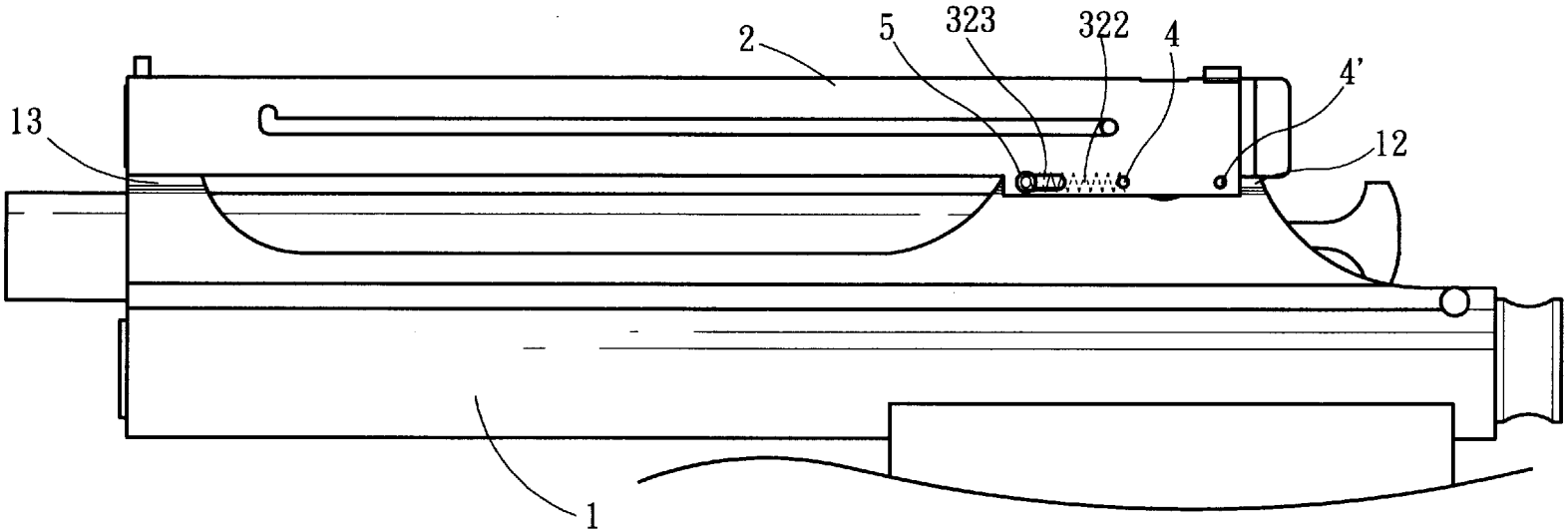
Figures 2, 3:
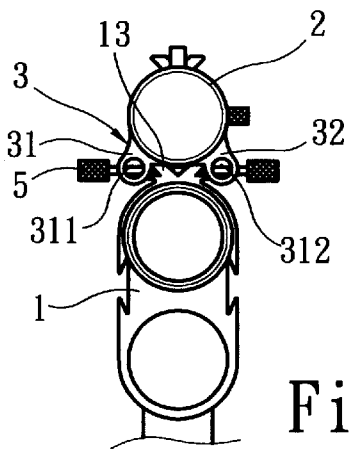

Referring to FIGS. 1, 2, 3-1 and 3-2, the present invention includes a plurality of anchor seats such as a first anchor seat 11, a second anchor seat 12 and a front anchor seat 13 located on a barrel 1, and a rapid detaching means 3 located on a magazine 2. The first and second anchor seats 11 and 12 have respectively one inwardly inclined side facing each other to form a first latch member 111 and a second latch member 121. The rapid detaching means 3 includes a first foot flange 31 and a second foot flange 32 attached in parallel at two sides of the magazine 2. The first and second foot flange 31 and 32 have respectively an axial first and second groove 311 and 321 formed therein which in turn hold respectively a first and a second elastic member 312 and 322 (may be a spring and the like) therein. At a front section of the first and second foot flange 31 and 32, there is provided with a first and a second slot 313 and 323 respectively. A transverse pulling bar 5 is provided to run through the first and second slot 313 and 323, and are pressed by one end of the elastic members 312 and 322. The pulling bar 5 has both ends extending outside the foot flanges 31 and 32.

At a middle and rear section of the first and second foot flange 31 and 32, there are respectively a first bar 4 and a second bar 4' transversely running through the foot flanges 31 and 32. The first bar 4 is pressed by another end of the elastic members 312 and 322.

For mounting the magazine 2 on the barrel 1, placing the second latch bar 4' to the second latch member 121, then moving the pulling bar 5 rearward and placing the pulling bar 5 behind the first latch member 111 and release the pulling bar 5. The restoring force of the elastic members 312 and 322 located between the bars 4 and 5 will then push the pulling bar 5 forward to engage with the first latch member 111. Thus by means of the bars 5 and 4' being engaged and latched respectively with the latch members 111 and 121, the magazine 2 may be held securely on the barrel 1. At that position, the front end of the magazine 2 may rest on the front anchor seat 13 for preventing unnecessary vibration when in use.

Figures 2, 4:
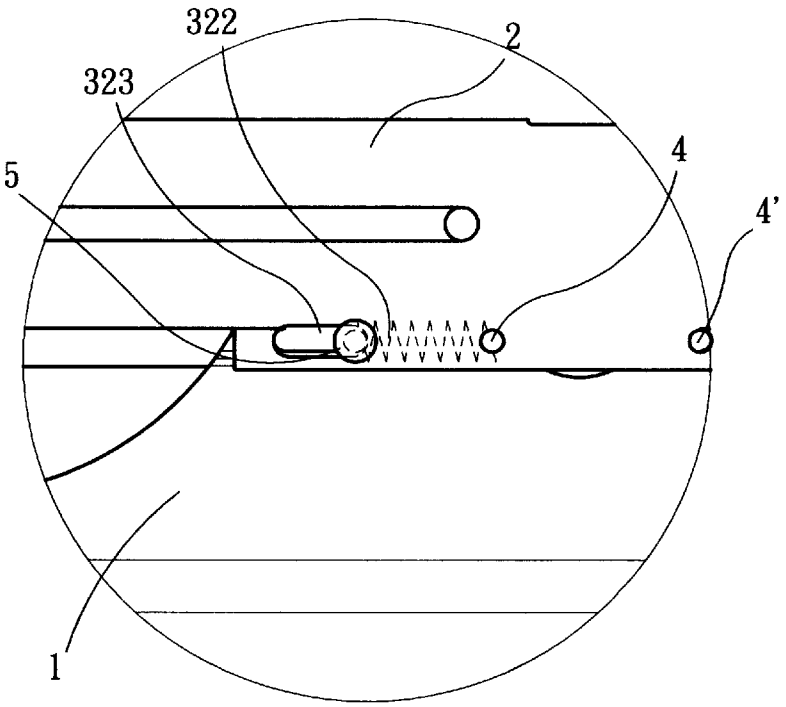
Figures 1, 4:
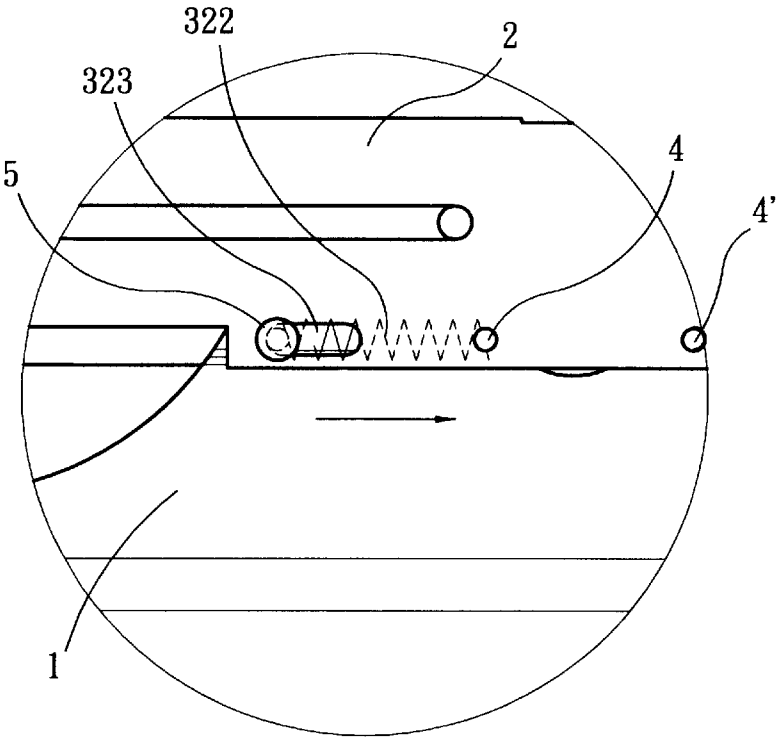
Figure 4:
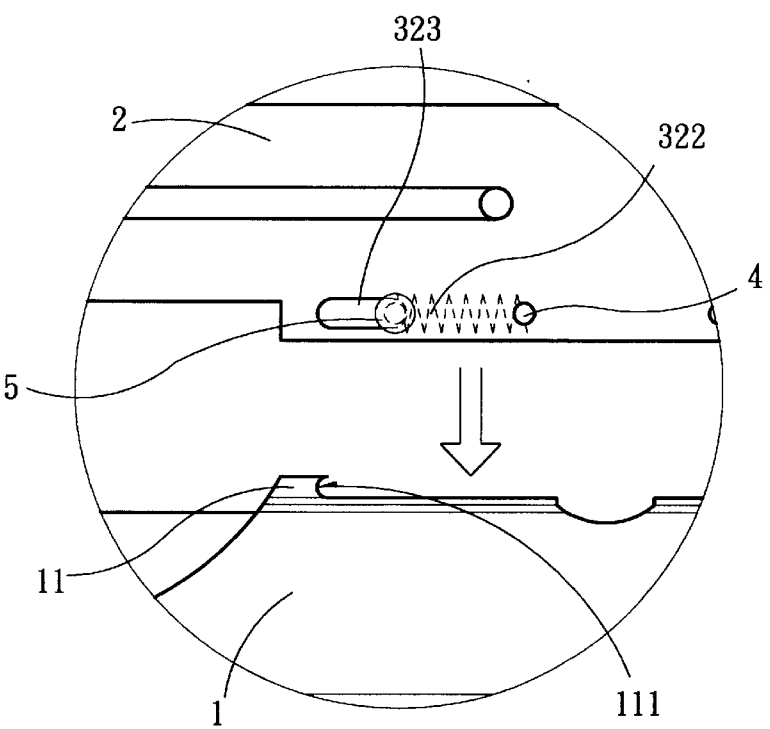
Figures 3, 4:
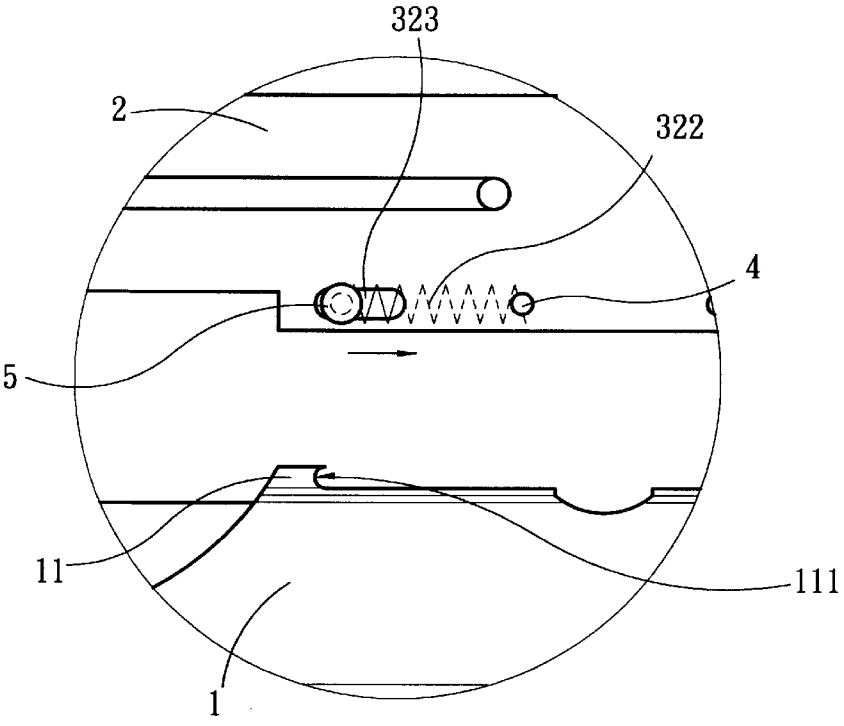

Referring to FIGS. 4-1 through 4-4, for detaching the magazine 2 from the barrel 1, moving the pulling bar 5 rearward in the slots 313 and 323 to disengage with the first latch member 111, then the magazine 2 may be removed easily for refilling cartridges (not shown in the figures), or replacing a filled magazine 2. For mounting a new magazine 2 on the barrel 1, firstly engaging the second bar 4' with the second latch member 121, then move the pulling bar 5 rearward (to compress the elastic members 312 and 322) and mount the magazine 2 flatly on the barrel 1, thereafter release the pulling bar 5, the restoring force of the elastic members 312 and 322 will push the pulling bar 5 forward in the slots 313 and 323 until the pulling bar 5 engaged firmly with the first latch member 111. It may thus be seen, through the structure of the present invention, the magazine 2 may be detached from or engaged with the barrel I easily and quickly.

Figure 5:
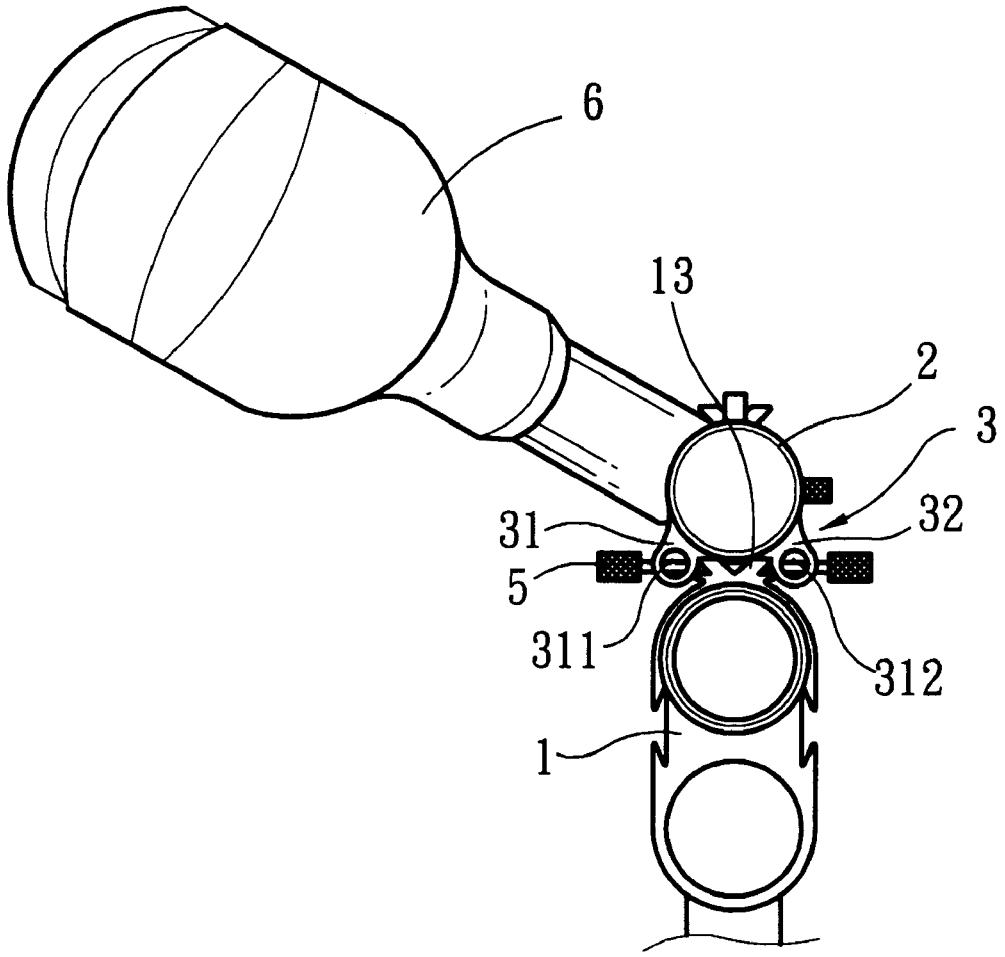
FIG. 5 is a schematic front view of a second embodiment of the present invention.

FIG. 5 shows another embodiment of the present invention. It has a funnel type magazine 6 which has greater capacity for holding more cartridges. The funnel type magazine 6 may also be detached or mounted rapidly when equipped with the present invention.

While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A rapid detachable structure for a color ball toy gun, the rapid detachable structure comprising:

a barrel having at least one anchor seat located thereon; and a magazine having a rapid detaching means mating and engageable with the anchor seat for rapidly replacing the magazine on the barrel, wherein the rapid detaching means includes a pair of foot flanges located at two sides of the magazine, two transverse bars respectively running through the foot flanges at a middle and a rear section thereof, and a transverse pulling bar, each foot flange has an axial groove formed therein for holding an elastic member and a slot formed in a front section thereof, the pulling bar running through the slot of the flanges and having two ends extending outside the foot flanges.

2. The detachable structure for a color ball toy gun according to claim 1, wherein the elastic member has one end pressing against the transverse bar at the middle section and another end pressing against the pulling bar.

3. The rapid detachable structure for a color ball toy gun according to claim 2, wherein the elastic member is a spring.

4. The rapid detachable structure for a color ball toy gun according to claim 3, wherein the anchor seat has a latch member located at one end thereof.

5. The rapid detachable structure for a color ball toy gun according to claim 2, wherein the anchor seat has a latch member located at one end thereof.

6. The rapid detachable structure for a color ball toy gun according to claim 5, wherein the rapid detaching means is located on a funnel type magazine for rapidly replacing the funnel type magazine.

7. The rapid detachable structure for a color ball toy gun according to claim 2, wherein the rapid detaching means is located on a funnel type magazine for rapidly replacing the funnel type magazine.

8. The rapid detachable structure for a color ball toy gun according to claim 2, wherein the barrel has a front anchor seat located at a front end thereof for holding the magazine and preventing vibration.

9. The rapid detachable structure for a color ball toy gun according to claim 1, wherein the elastic member is a spring.

10. The rapid detachable structure for a color ball toy gun according to claim 9, wherein the anchor seat has a latch member located at one end thereof.

11. The rapid detachable structure for a color ball toy gun according to claim 10, wherein the rapid detaching means is located on a funnel type magazine for rapidly replacing the funnel type magazine.

12. The rapid detachable structure for a color ball toy gun according to claim 9, wherein the rapid detaching means is located on a funnel type magazine for rapidly replacing the funnel type magazine.

13. The rapid detachable structure for a color ball toy gun according to claim 9, wherein the barrel has a front anchor seat located at a front end thereof for holding the magazine and preventing vibration.

14. The rapid detachable structure for color ball toy gun according to claim 1, wherein the anchor seat has a latch member located at one end thereof.

15. The rapid detachable structure for a color ball toy gun according to claim 14, wherein the rapid detaching means is located on a funnel type magazine for rapidly replacing the funnel type magazine.

16. The rapid detachable structure for a color ball toy gun according to claim 14, wherein the barrel has a front anchor seat located at a front end thereof for holding the magazine and preventing vibration.

17. The rapid detachable structure for color ball toy gun according to claim 1, wherein the rapid detaching means is located on a funnel type magazine for rapidly replacing the funnel type magazine.

18. The rapid detachable structure for a color ball toy gun according to claim 17, wherein the barrel has a front anchor seat located at a front end thereof for holding the magazine and preventing vibration.

19. The rapid detachable structure for color ball toy gun according to claim 1, wherein the barrel has a front anchor seat located at a front end thereof for holding the magazine and preventing vibration.

* * * * *